US008651913B1

(12) United States Patent
Lin

(10) Patent No.: US 8,651,913 B1
(45) Date of Patent: Feb. 18, 2014

(54) MODULARIZED CONTACT TYPE OF CONDUCTIVE BUILDING BLOCK

(71) Applicant: Chia-Yen Lin, Dongguan (CN)

(72) Inventor: Chia-Yen Lin, Dongguan (CN)

( * ) Notice: Subject to any disclaimer, the term of this patent is extended or adjusted under 35 U.S.C. 154(b) by 0 days.

(21) Appl. No.: 14/023,767

(22) Filed: Sep. 11, 2013

(51) Int. Cl.
*A63H 33/04* (2006.01)

(52) U.S. Cl.
USPC ..... 446/91

(58) Field of Classification Search
USPC ..... 446/85, 91, 118, 124, 477, 484
See application file for complete search history.

(56) References Cited

U.S. PATENT DOCUMENTS

| | | | | |
|---|---|---|---|---|
| 3,696,548 | A * | 10/1972 | Teller | 446/91 |
| 4,743,202 | A * | 5/1988 | Bach | 439/53 |
| 4,883,440 | A * | 11/1989 | Bolli | 446/91 |
| 5,848,503 | A * | 12/1998 | Toft et al. | 52/173.1 |
| 6,062,937 | A * | 5/2000 | Kikuchi | 446/91 |
| 6,443,796 | B1 * | 9/2002 | Shackelford | 446/91 |
| 6,585,553 | B1 * | 7/2003 | Fetridge et al. | 446/91 |
| 6,805,605 | B2 * | 10/2004 | Reining et al. | 446/91 |
| 6,939,192 | B1 * | 9/2005 | Munch et al. | 446/91 |
| 7,846,002 | B1 * | 12/2010 | Mikesell et al. | 446/91 |
| 8,079,890 | B2 * | 12/2011 | Seligman | 446/124 |
| 2008/0166926 | A1 * | 7/2008 | Seymour et al. | 439/701 |

FOREIGN PATENT DOCUMENTS

| | | |
|---|---|---|
| TW | M408402 | 8/2011 |

* cited by examiner

*Primary Examiner* — Kurt Fernstrom

(57) ABSTRACT

A building block includes: a brick, at least one pair of fixation posts, a circuit board and a base. The brick includes at least one pair of studs projected from a top thereof. A stud hole penetrates through each stud. The fixation post includes an insulating piece and a conductive piece. A top of the insulating piece is disposed in the stud hole and the conductive piece is disposed in the insulating piece. The conductive piece has an insertion electrode, a contact electrode and a connection electrode extended from a top, a side and a bottom thereof, respectively. The circuit board and the base are sleeved on the fixation posts. The circuit board includes a positive electrode circuit and a negative electrode circuit respectively contacted with the pair of the fixation posts and a functional unit electrically connected with both electrode circuits.

9 Claims, 10 Drawing Sheets

MODULARIZED CONTACT TYPE OF CONDUCTIVE BUILDING BLOCK

CROSS-REFERENCE TO RELATED APPLICATION

This application claims the priority of Chinese patent application No. 201310267961.4, filed on Jun. 28, 2013, which is incorporated herewith by reference

BACKGROUND OF THE INVENTION

1. Field of the Invention

The present invention relates generally to a building block, and in particular to a modularized contact type of conductive building block.

2. The Prior Arts

New types of toys that can boost intelligence, such as building blocks, are developed with the advance of the electronic industry. For example, the conventional building block further includes a circuit board, LED lights, speakers, etc. disposed therein. After a plurality of building blocks are connected with each other, the building blocks would emit light or play music, which provides more entertainment and fun.

A conventional electric connection building blocks, such as Taiwan Utility Model Patent No. M408402, include fixation posts mounted on a circuit board. The fixation post includes a positive conducting unit and a negative conducting unit. Each of the positive and negative conducting units has a metal lead. The metal leads are soldered on the circuit board and connected with the electronic components by the circuit board.

However, the positive and negative electrodes are simultaneously assembled to the fixation post of the conventional light emitting building block. Thus, the fixation post has a lot of components and a complex structure. Moreover, it needs to solder the positive and negative conducting units on the circuit board, but the soldering process is not only expensive but also not environmental friendly.

Furthermore, both of the positive electrode and the negative electrode are assembled in the same stud hole. If any metal foreign matter is fallen into the stud or the stud is compressed and deformed, it is likely that both of electrodes are contacted with each other to form the electric connection. Short circuit would occur.

SUMMARY OF THE INVENTION

To overcome the disadvantages of conventional designs which has a lot of components, a complex structure, a need for a soldering process and a risk of short circuit, a primary objective of the present invention is to provide a modularized contact type of conductive building block, which has few components, a simple structure and improved safety and is soldering free.

In order to achieve the objective, a modularized contact type of conductive building block according to the present invention includes: a hollow brick, at least one pair of fixation posts, a circuit board and a base. The brick includes at least one pair of studs projected from a top thereof and an opening defined in a bottom thereof and communicates with an interior thereof. A stud hole penetrates through the stud and communicates with the interior of the brick. The at least one pair of fixation posts are disposed in the stud holes, respectively. The fixation post includes an insulating piece and a conductive piece. The insulating piece includes an assembling hole vertically penetrating through an interior thereof and an extension groove formed at a side thereof. The extension groove communicates with the assembling hole. The conductive piece is disposed in the assembling hole of the insulating piece. An insertion electrode is located at a top of the conductive piece and projected out of the assembling hole. A contact electrode is horizontally extended from a side of the conductive piece. The contact electrode penetrates through and projects out of the extension groove. A connection electrode is vertically extended from a bottom of the conductive piece. The circuit board is disposed in the interior of the brick and sleeved on the fixation posts. The circuit board has a positive electrode circuit, a negative electrode circuit and a functional unit. The positive electrode circuit is contacted with the contact electrode of a first fixation post of each pair of fixation posts, and the first fixation post is defined as a positive electrode fixation post and the conductive piece of the positive electrode fixation post is defined as a positive conductive piece. The negative electrode circuit is contacted with the contact electrode of a second fixation post of each pair of fixation posts, and the second fixation post is defined as a negative electrode fixation post and the conductive piece of the negative electrode fixation post is defined as a negative conductive piece. The functional unit is electrically connected with the positive and negative electrode circuits. The base is disposed in the interior of the brick. The base includes at least one pair of through holes allowing the fixation posts to pass through.

The modularized contact type of conductive building block according to the present invention provides the positive and negative electrode fixation posts having the same structure. Moreover, the insulating piece and the conductive piece of the fixation post have simple structures and are easy to assemble. Therefore, the present invention can effectively simplify the conventional structural designs and greatly reduce the manufacturing cost. Moreover, tops of the fixation posts are pressed against the brick, the contact electrodes of the fixation posts are pressed against the circuit board, the circuit board is pressed against the base and the base is fixed in the brick. Therefore, the conductive pieces are securely pressed against and contacted with the circuit board and it does not need to electrically connect the conductive piece with the circuit board by the soldering process. Thus, the building block according to the present invention has the advantage of being environmental friendly and labor saving.

Furthermore, the positive and the negative electrodes of the conductive piece are decided by the contact electrode of the conductive piece being contacted with the positive electrode circuit or the negative electrode circuit of the circuit board, therefore, after the building block is assembled, the conductive pieces can be clearly classified as the positive electrode conductive piece or the negative electrode conductive piece. Moreover, each stud hole has only one electrode disposed therein. Therefore, even the metal foreign matter is fallen into the stud hole or the stud being compressed and deformed, it does not cause the short circuit. Therefore, the safety of the building blocks is secured.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
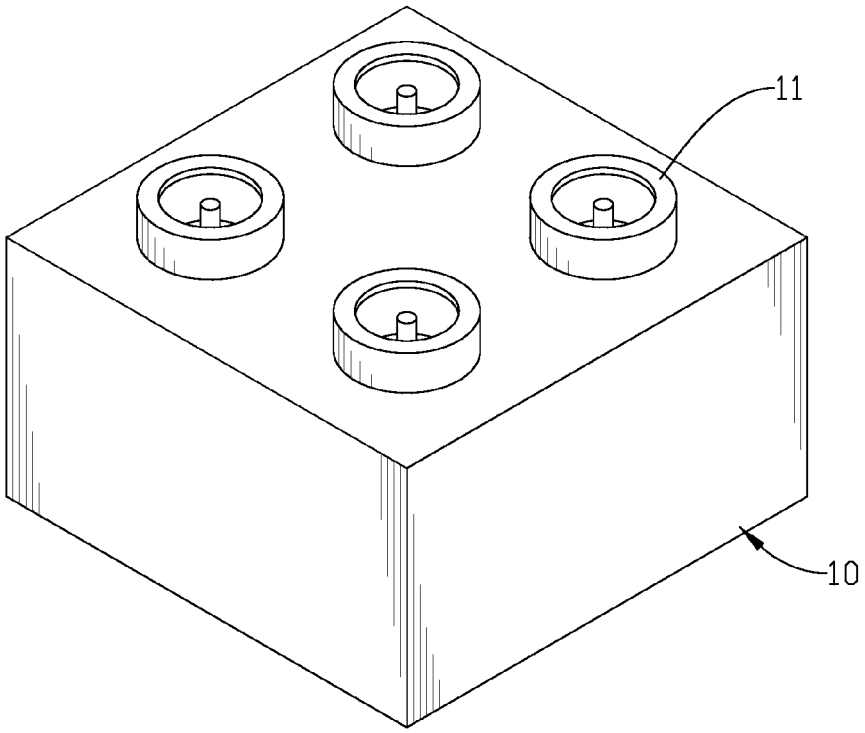
FIG. 1 is a perspective view showing a modularized contact type of conductive building block according to a first embodiment of the present invention.
Figure 2:
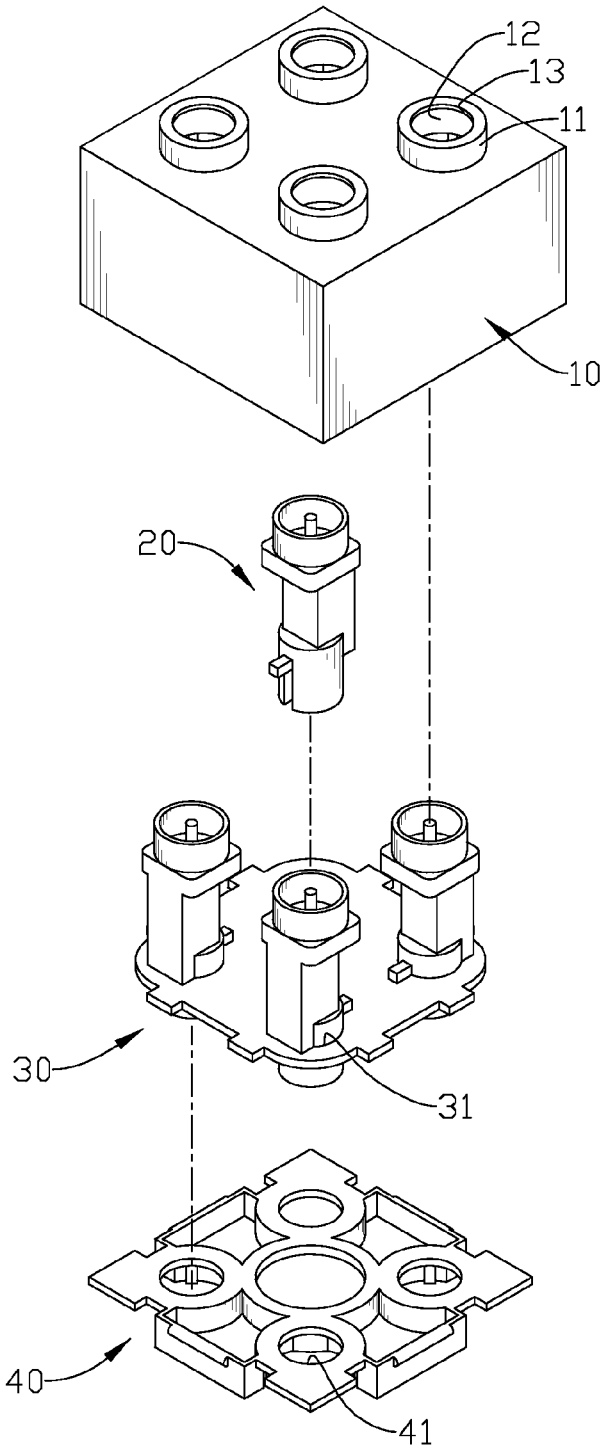
FIG. 2 is an exploded view showing the modularized contact type of conductive building block according to the first embodiment of the present invention.

With reference to FIGS. 1 and 2, a modularized contact type of conductive building block according to a first preferred embodiment of the present invention includes a brick 10, at least one pair of fixation posts 20, a circuit board 30 and a base 40. The brick 10 is a light-transmittable hollow cube. The brick 10 includes at least one pair of ring-shaped studs 11 projected from a top thereof. A stud hole 12 penetrates through the stud 11 and communicates with an interior of the brick 10. A top edge of an inner wall of the stud hole 12 extends inward to form a ring-shaped retaining ridge 13. An opening is defined in a bottom of the brick 10 and communicates with the interior of the brick 10. Preferably, the top of the brick 10 is projected to form two pairs of studs which are symmetrically arranged in a matrix.

Figure 3:
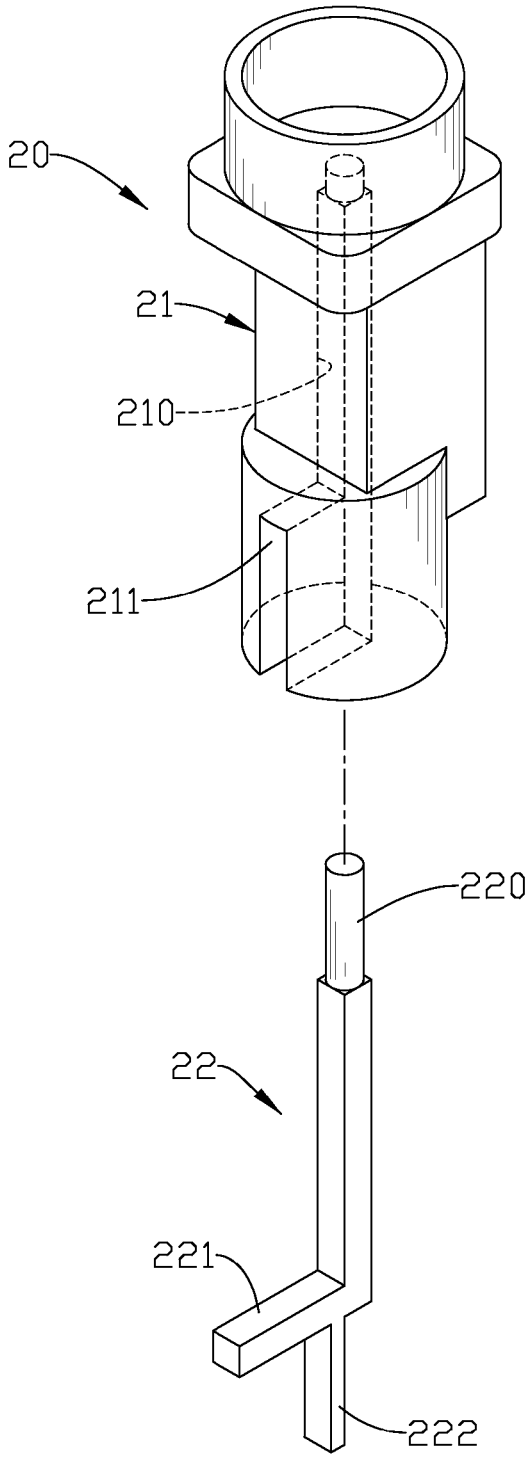
FIG. 3 is an exploded view showing a fixation post according to the first embodiment of the present invention.
Figure 6:
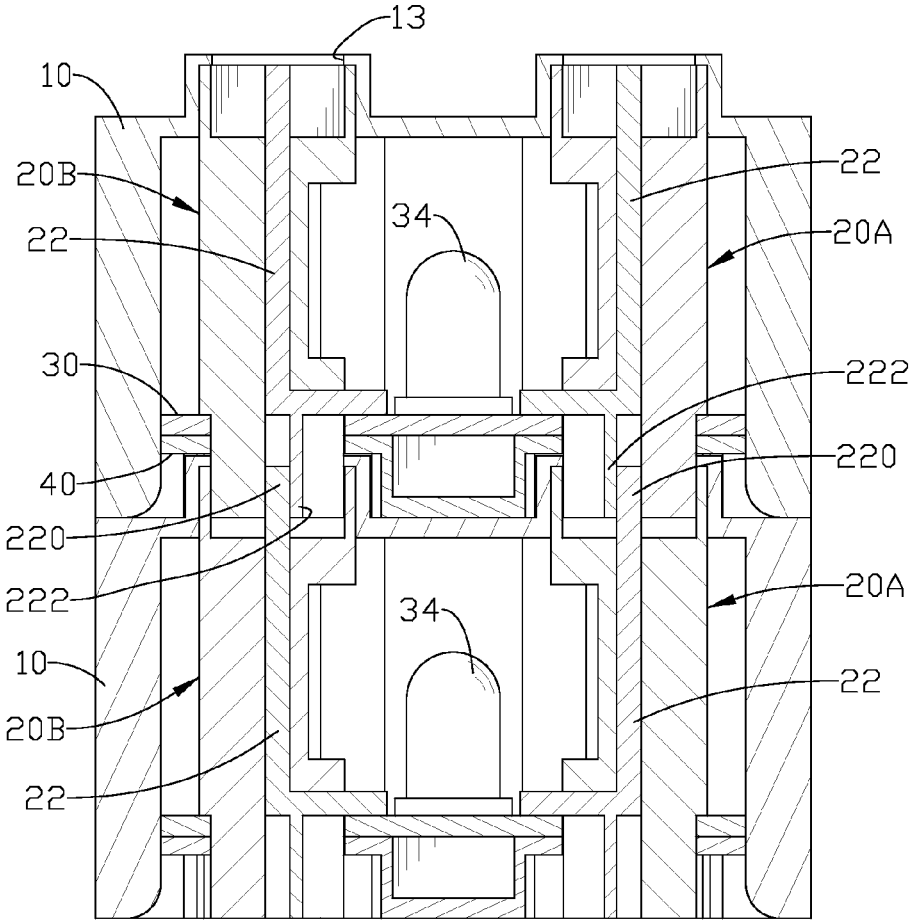
FIG. 6 is a cross-sectional view showing two of the modularized contact type of conductive building blocks according to the first embodiment of the present invention connected with each other.

The at least one pair of fixation posts 20 are disposed in the stud holes 12 of the stud 11 of the brick 10 and tops of the fixation posts 20 are pressed against the ring-shaped retaining ridges 13 (as shown in FIG. 6), respectively. According to the first embodiment, the brick 10 has two pairs of fixation posts 20 symmetrically arranged in a matrix. Referring to FIG. 3, each fixation post 20 includes an insulating piece 21 and a conductive piece 22. A top of the insulating piece 21 is located in the stud hole 12. The insulating piece 21 includes an assembling hole 210 vertically penetrating through an interior thereof and an extension groove 211 formed at a side of a bottom thereof. The extension groove 211 communicates with the assembling hole 210. The insulating piece 21 according to the first embodiment is only a type of the present invention. According to another type, the insulating piece 21 may have two half pieces face-to-face joining together. According to still another type, the insulating piece 21 may also have upper and lower tubes connected with each other in an insertion way. Moreover, the top and the bottom of the insulating piece 21 of the fixation post 20 may be shaped in a circle or a rectangle. The types and the shapes of the fixation posts 20 according to the present invention are not limited.

The conductive piece 22 is disposed in the assembling hole 210 of the insulating piece 21. An insertion electrode 220 is located at a top of the conductive piece 22 and projected out of the assembling hole 210. A contact electrode 221 is horizontally extended from a side of a bottom of the conductive piece 22. The contact electrode 221 penetrates through and projects out of the extension groove 211. A connection electrode 222 is vertically extended from the bottom of the conductive piece 22 and misaligned with the insertion electrode 220.

Figure 4:
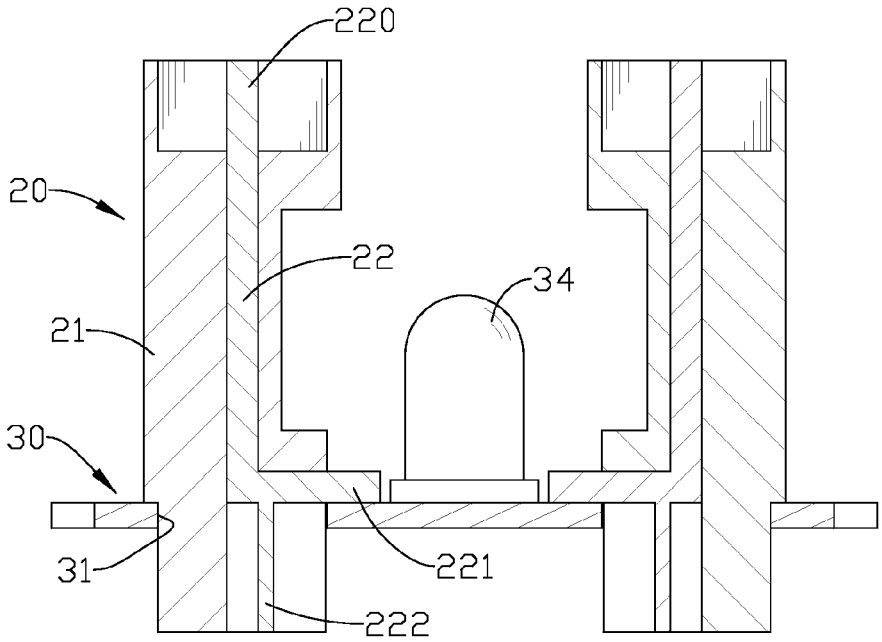
FIG. 4 is a vertical cross-sectional view showing the fixation posts mounted on a circuit board according to the first embodiment of the present invention.
Figure 5:
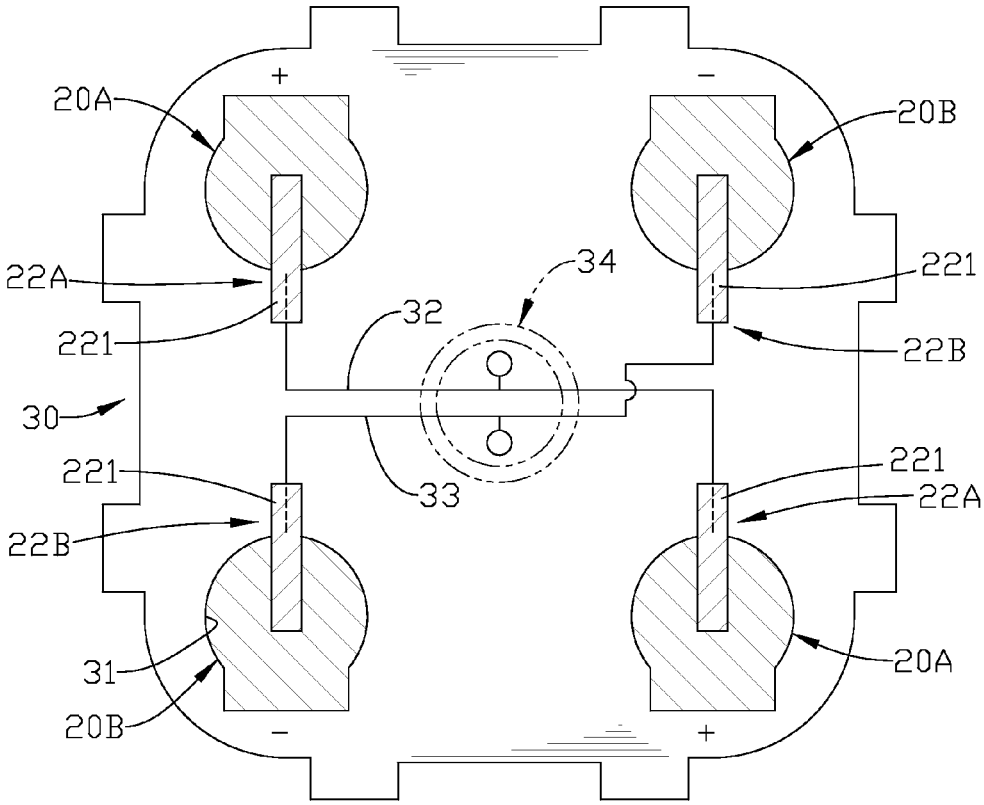
FIG. 5 is a horizontal cross-sectional view showing the fixation posts mounted on the circuit board according to the first embodiment of the present invention.

Referring to FIGS. 2, 4 and 5, the circuit board 30 is disposed in the interior of the brick 10. The circuit board 30 includes a plurality of insertion through holes 31 to sleeve on the corresponding fixation posts 20, respectively. Furthermore, the circuit board 30 has a positive electrode circuit 32 and a negative electrode circuit 33 (as shown in FIG. 5). Each pair of fixation posts 20 has a first fixation post and a second fixation post. The contact electrode 221 of the conductive piece 22 of the first fixation post of each pair of fixation posts 20 is pressed against the circuit board 30, so that the contact electrode 221 of the first fixation post is contacted with and electrically connected with the positive electrode circuit 32. Due to being contacted with the positive electrode circuit 32, the first fixation post is defined as a positive electrode fixation post 20A and the conductive piece 22 of the positive electrode fixation post 20A is defined as a positive electrode conductive piece 22A. The contact electrode 221 of the conductive piece 22 of the second fixation post of each pair of fixation posts 20 is pressed against the circuit board 30, so that the contact electrode 221 of the second fixation post is contacted with and electrically connected with the negative electrode circuit 33. Due to being contacted with the negative electrode circuit 33, the second fixation post is defined as a negative electrode fixation post 20B and the conductive piece 22 of the negative electrode fixation post 20B is defined as a negative electrode conductive piece 22B. Preferably, the positive electrode fixation post 20A and the negative electrode fixation post 20B are symmetrically arranged in a matrix and crisscross with each other, such that both of the fixation posts immediately adjacent to two sides of the positive electrode fixation post 20A are the negative electrode fixation posts 20B and both of the fixation posts immediately adjacent to two sides of the negative electrode fixation post 20B are the positive electrode fixation posts 20A. Similarly, the positive electrode conductive pieces 22A and the negative electrode conductive pieces 22B are symmetrically arranged in a matrix and crisscross with each other.

The circuit board 30 further includes a functional unit 34 connected with the positive electrode circuit 32 and the negative electrode circuit 33. Preferably, the functional unit 34 is a LED light or a sound generating device.

Referring to FIG. 2, the base 40 is disposed in the interior of the brick 10. Moreover, the base 40 is located under the circuit board 30 and pressed against the bottom of the circuit board 30. The base 40 includes at least one pair of through holes 41 and the bottoms of the fixation posts 20 penetrate through the through holes 41 to pass through the base 40. Preferably, the base 40 is hollow out.

Referring to FIG. 6, when assembling two building blocks according to the first embodiment, the bottom of the positive electrode fixation post 20A in the upper brick 10 is correspondingly inserted into the top of the positive electrode fixation post 20A in the lower brick 10 and the connection electrode 222 of the conductive piece 22 in the upper positive electrode fixation post 20A is contacted with the insertion electrode 220 of the conductive piece 22 in the lower positive electrode fixation post 20A, thereby electrically connecting the positive electrode fixation posts 20A in the upper and lower bricks 10 with each other. At this moment, the bottom of the negative electrode fixation post 20B in the upper brick 10 is correspondingly inserted into the top of the negative electrode fixation post 20B in the lower brick 10 and the connection electrode 222 of the conductive piece 22 in the upper positive electrode fixation post 20B is contacted with the insertion electrode 220 of the conductive piece 22 in the lower positive electrode fixation post 20B, thereby electrically connecting the positive electrode fixation posts 20B in the upper and lower bricks 10 with each other.

After the building blocks are connected with each other, the positive electrode fixation post 20A and the negative electrode fixation post 20B of the most top or the most bottom building block are respectively connected to a positive electrode and a negative electrode of a power supply, thereby supplying power to the functional unit 34 to emit light or generate sound.

Figure 7:
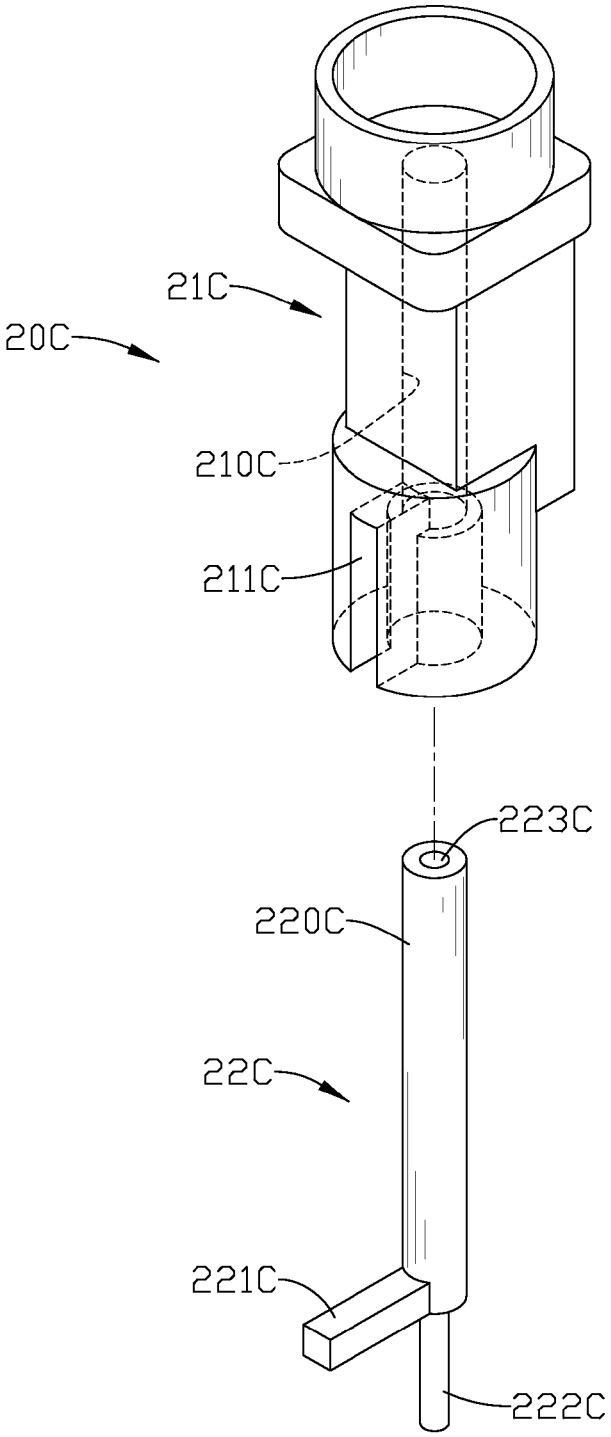
FIG. 7 is an exploded view showing a fixation post according to a second embodiment of the present invention.
Figure 8:
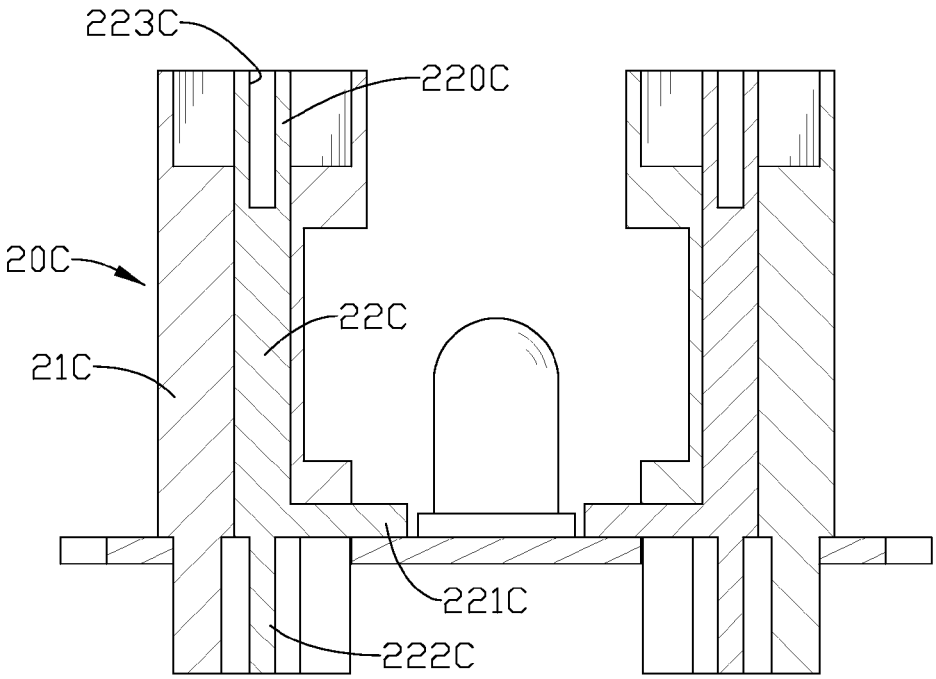
FIG. 8 is a vertical cross-sectional view showing the fixation posts mounted on the circuit board according to the second embodiment of the present invention.

A modularized contact type of conductive building block according to a second embodiment of the present invention has a structure essentially the same as that of the first embodiment. However, the type of the fixation post 20C is slightly different from that of the first embodiment. Referring to FIGS. 7 and 8, a conductive piece 22C is disposed in an assembling hole 210C of the insulating piece 21C. An insertion electrode 220C is located at a top of the conductive piece 22C and projected out of the assembling hole 210C. A top end of the insertion electrode 220C is recessed to form an insertion hole 223C. A contact electrode 221C is horizontally extended from a side of a bottom of the conductive piece 22C. The contact electrode 221C penetrates through and projects out of the extension groove 211C. A connection electrode 222C is vertically extended from the bottom of the conductive piece 22C and located corresponding to the insertion hole 223C. The diameter of the connection electrode 222C is corresponding to the diameter of the insertion hole 223C.

Figure 9:
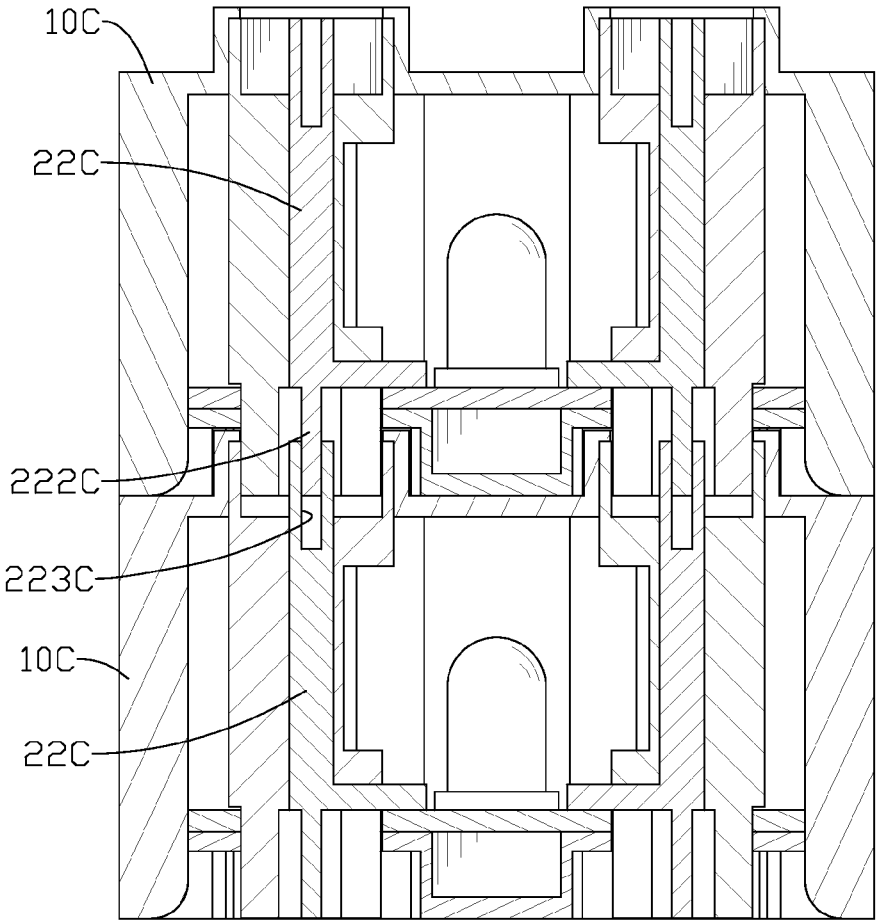
FIG. 9 is a cross-sectional view showing two of the modularized contact type of conductive building blocks according to the second embodiment of the present invention connected with each other.

Referring to FIG. 9, when assembling two building blocks according to the second embodiment, the connection electrode 222C of the conductive piece 22C in the upper brick 10C is inserted into the insertion hole 223C of the conductive piece 22C in the lower brick 10C, thereby electrically connecting the conductive pieces 22C in the upper and lower bricks 10C with each other. Except the description mentioned above, the second embodiment has a structure, an assembling method and functions the same as that of the first embodiment. Thus, the descriptions about the structure, assembling method and functions of the second embodiment are not repeated again here.

Figure 10:
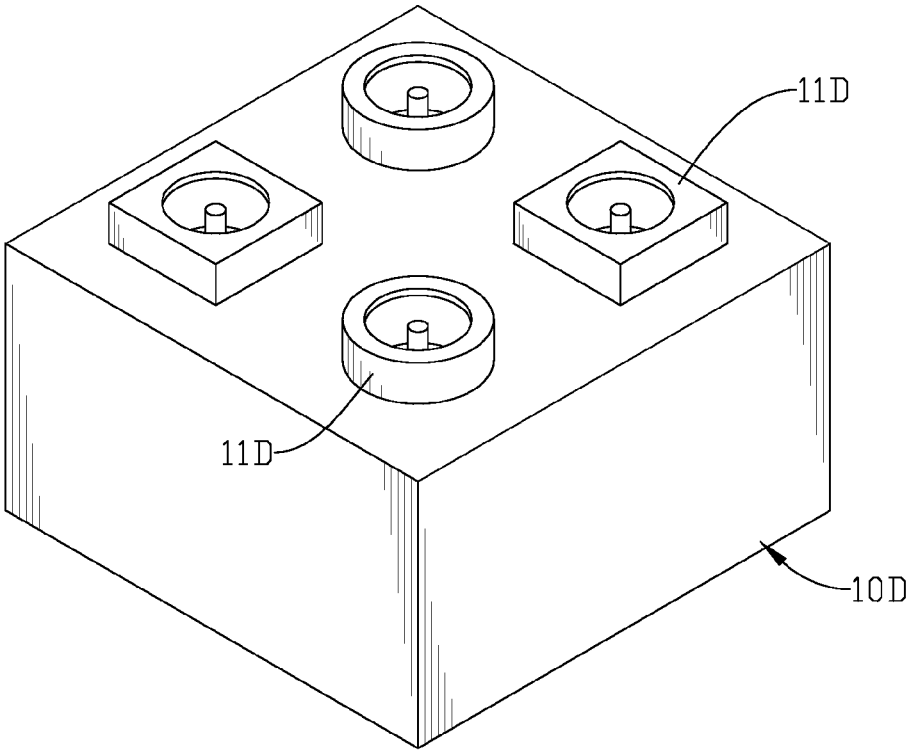
FIG. 10 is a perspective view showing a modularized contact type of conductive building block according to a third embodiment of the present invention.

Referring to FIG. 10, a modularized contact type of conductive building block according to a third embodiment has a structure essentially the same as that of the first embodiment. Nevertheless, a first stud of the at least one pair of studs 11D of the brick 10D is shaped in a circle and a second stud 11D is shaped in a rectangle. When the brick 10D has a plurality pairs of studs 11D, the circular and rectangular studs 11D are symmetrically arranged in a matrix and crisscross with each other, such that both studs 11D immediately adjacent to two sides of the circular stud 11D are the rectangular studs and both studs 11D immediately adjacent to two sides of the rectangular stud are the circular studs 11D. Except the description mentioned above, the third embodiment has a structure, an assembling method and functions the same as that of the first embodiment. Thus, the descriptions about the structure, assembling method and functions of the third embodiment are not repeated again here.

It is easy to distinguish locations of the positive and negative electrode fixation posts from the appearances of the studs 11D according to the third embodiment. Therefore, the building block according to the third embodiment is equipped with a fool-proofing function when assembling. For example, the positive electrode fixation post is configured as a circular stud 11D and the negative electrode fixation post is configured as a rectangular stud 11D. When connecting the building blocks together, the user can accurately connect the positive electrode fixation posts with each other and connect the negative electrode fixation posts with each other. It can prevent from misconnecting the positive electrode fixation post with the negative electrode fixation post.

No matter it is the positive electrode fixation post 20A or the negative electrode fixation post 20B, the modularized contact type of conductive building block according to the present invention provides the positive and negative electrode fixation posts having the same structure. The insulating piece 21 and the conductive piece 22 of the fixation post 20 have simple structures and are easy to assemble, so the complex designs is significantly simplified and the manufacturing cost is greatly reduced.

Furthermore, the positive and negative electrodes are decided by the contact electrode 221 of the conductive piece 22 being contacted with the positive electrode circuit 32 or the negative electrode circuit 33 of the circuit board 30. Therefore, when the contact electrode 221 is contacted with the positive electrode circuit 32, the conductive piece 22 is defined as the positive electrode conductive piece 22A. And, when the contact electrode 221 is contacted with the negative electrode circuit 33, the conductive piece 22 is defined as the negative electrode conductive piece 22B. Therefore, different from the conventional designs having both of the positive and negative electrodes simultaneously disposed in each stud hole, each stud hole 12 according to the present invention has only one single electrode. Thus, it does not need to worry about the metal foreign matter fallen into the stud hole 12 or the studs being compressed and deformed, which causes the positive and negative electrodes contacted with each other and short circuit. Therefore, the safety of the building blocks is increased.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A modularized contact type of conductive building block, comprising:

A hollow brick having at least one pair of studs projected from a top thereof and an opening defined in a bottom thereof and communicating with an interior thereof, a stud hole penetrating through the stud and communicating with the interior of the brick;

at least one pair of conductive pieces disposed in the stud holes, a top of the conductive piece forming an insertion electrode, a contact electrode horizontally extended from a side of the conductive piece, and a connection electrode extended from a bottom of the conductive piece;

a circuit board disposed in the brick, the circuit board including a positive electrode circuit, a negative electrode circuit and a functional unit, the positive electrode circuit contacted with the contact electrode of a first conductive piece of each pair of conductive pieces and the first conductive piece being defined as a positive electrode conductive piece, the negative electrode circuit contacted with the contact electrode of a second conductive piece of each pair of conductive pieces and the second conductive piece being defined as a negative electrode conductive piece, the functional unit electrically connected with the positive and negative electrode circuits; and a base disposed in the bottom of the brick, the base including at least one pair of through holes to be sleeved on the conductive pieces.

2. The building block as claimed in claim 1, wherein the building block further includes at least one pair of insulating pieces corresponding to the at least one pair of conductive pieces, each insulating piece includes an assembling hole penetrating through an interior thereof and an extension groove formed at a side thereof and communicating with the assembling hole, each conductive piece is disposed in the assembling hole of the insulating piece, the insertion electrode is projected out of a top end of the assembling hole, the contact electrode is projected out of the extension groove, and the connection electrode is projected out of a lower end the assembling hole.

3. The building block as claimed in claim 2, wherein tops of the at least one pair of the insulating pieces are pressed against the brick, and the contact electrodes of the at least one pair of the conductive pieces are pressed against the circuit board.

4. The building block as claimed in claim 1, wherein the connection electrode of conductive piece is misaligned with the insertion electrode of conductive piece.

5. The building block as claimed in claim 1, wherein the insertion electrode of the conductive piece includes an insertion hole formed in a top thereof and a location of the connection electrode extending downward is corresponding to the insertion hole.

6. The building block as claimed in claim 1, wherein the functional unit includes a LED light.

7. The building block as claimed in claim 2, wherein a top edge of inner wall of the stud hole of the stud extends inward to form a ring-shaped retaining ridge, a top of the insulating piece is pressed against the ring-shaped retaining ridge.

8. The building block as claimed in claim 6, wherein a first stud of the at least one pair of studs is shaped in a circle and a second stud of the at least one pair of studs is shaped in a rectangle.

9. The building block as claimed in claim 1, wherein a first stud of the at least one pair of studs is shaped in a circle and a second stud of the at least one pair of studs is shaped in a rectangle.

* * * * *